US010836164B2

(12) United States Patent
Kuramochi

(10) Patent No.: US 10,836,164 B2
(45) Date of Patent: Nov. 17, 2020

(54) INK JET HEAD AND INK JET RECORDING APPARATUS

(71) Applicant: KONICA MINOLTA, INC., Tokyo (JP)

(72) Inventor: Yusuke Kuramochi, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/329,414

(22) PCT Filed: Aug. 10, 2017

(86) PCT No.: PCT/JP2017/029095
§ 371 (c)(1),
(2) Date: Feb. 28, 2019

(87) PCT Pub. No.: WO2018/043090
PCT Pub. Date: Mar. 8, 2018

(65) Prior Publication Data

US 2019/0224972 A1 Jul. 25, 2019

(30) Foreign Application Priority Data

Sep. 5, 2016 (JP) ..... 2016-173213

(51) Int. Cl.
*B41J 2/14* (2006.01)
*B41J 2/19* (2006.01)
*B41J 2/18* (2006.01)

(52) U.S. Cl.
CPC ..... *B41J 2/14201* (2013.01); *B41J 2/14209* (2013.01); *B41J 2/18* (2013.01);
(Continued)

(58) Field of Classification Search
CPC ..... B41J 2/14201; B41J 2/14209; B41J 2/18; B41J 2/19; B41J 2/17; B41J 2/17556; B41J 2002/14169; B41J 2202/07
See application file for complete search history.

(56) References Cited

U.S. PATENT DOCUMENTS 4,646,110 A * 2/1987 Ikeda et al. ..... 347/48
7,971,981 B2 7/2011 Nagashima et al.
(Continued)

FOREIGN PATENT DOCUMENTS

EP 2363291 A1 9/2011
JP 2016107418 A 6/2016
(Continued)

OTHER PUBLICATIONS

International Search Report corresponding to Application No. PCT/JP2017/029095; dated Oct. 10, 2017.
(Continued)

*Primary Examiner* — Juanita D Jackson
(74) *Attorney, Agent, or Firm* — Cantor Colburn LLP

(57) ABSTRACT

The present invention may provide an ink jet head and an ink jet recording apparatus capable of satisfactorily removing remaining air bubbles from a pressure chamber. The present invention may include: a common ink chamber that stores ink; at least one pressure chamber that communicates with the common ink chamber and causes a volume fluctuation using pressure generation means; a nozzle that communicates with the pressure chamber; a nozzle-part discharge path that communicates with the pressure chamber near the nozzle inside the pressure chamber and discharges ink out of the pressure chamber; and at least one discharge path that communicates with the pressure chamber at a position apart from the nozzle inside the pressure chamber and discharges ink out of the pressure chamber.

19 Claims, 10 Drawing Sheets

(52) U.S. Cl.
CPC ..... *B41J 2/19* (2013.01); *B41J 2002/14459* (2013.01); *B41J 2202/12* (2013.01)

(56) References Cited

U.S. PATENT DOCUMENTS

| | | | | |
|---|---|---|---|---|
| 8,079,673 | B2 * | 12/2011 | Urasaki | 347/65 |
| 2004/0125175 | A1 | 7/2004 | Yang et al. | |
| 2012/0098905 | A1 | 4/2012 | Xie et al. | |
| 2014/0078224 | A1 * | 3/2014 | Park et al. | 347/71 |

FOREIGN PATENT DOCUMENTS

| | | | |
|---|---|---|---|
| JP | 2016124146 | A | 7/2016 |
| WO | 2007006618 | A1 | 1/2007 |

OTHER PUBLICATIONS

Extended European Search Report corresponding to Application No. 17846098.6-1019/3508345 PCT/JP2017029095; dated Jul. 23, 2019.
CNIPA First Office Action Corresponding to CN201780053673.5; dated Feb. 3, 2020.

* cited by examiner

INK JET HEAD AND INK JET RECORDING APPARATUS

CROSS REFERENCE TO RELATED APPLICATIONS

This is the U.S. national stage of application No. PCT/JP2017/029095, filed on Aug. 10, 2017. Priority under 35 U.S.C. § 119(a) and 35 U.S.C. § 365(b) is claimed from Japanese Application No. 2016-173213, filed on Sep. 5, 2016; the disclosure of which is incorporated herein by reference.

TECHNICAL FIELD

The present invention relates to an ink jet head and an ink jet recording apparatus, and in particular to an ink jet head and an ink jet recording apparatus capable of satisfactorily removing remaining air bubbles from a pressure chamber.

BACKGROUND ART

Various ink jet heads such as a shear mode (edge (end) shooter or side shooter) type and a bend mode type have been proposed as ink jet heads used in general printers (ink jet recording apparatuses).

Some of these various ink jet heads include an ink circulation mechanism for returning the ink injected into a pressure chamber (ink channel) to a common ink chamber (Patent Literature 1 and Patent Literature 2). The purpose of providing the ink circulation mechanism is, for example, to remove air bubbles from the pressure chamber, to prevent sedimentation of ink, to reduce the amount of wasted ink at the time of initial introduction, and to prevent decap.

CITATION LIST

Patent Literature

Patent Literature 1: JP 2016-107418 A
Patent Literature 2: WO 2007/006618

SUMMARY OF INVENTION

Technical Problem

Regarding the ink jet heads described above, there is a possibility that a dead space having a small flow speed or no flow speed is formed in the pressure chamber, and air bubbles may remain in such a dead space.

It is therefore an object of the present invention to provide an ink jet head and an ink jet recording apparatus capable of satisfactorily removing remaining air bubbles from a pressure chamber.

Other objects of the present invention will become apparent from the following description.

Solution to Problem

The above object is solved by the following inventions.

In an embodiment, an ink jet head including:

a common ink chamber that stores ink;

at least one pressure chamber that communicates with the common ink chamber via an injection hole such that ink is injected into the pressure chamber from the common ink chamber via the injection hole, the pressure chamber causing a volume fluctuation using pressure generation means;

a nozzle that communicates with the pressure chamber and serves as a flow path of ink ejected to the outside from the pressure chamber;

a nozzle-part discharge path that communicates with the pressure chamber near the nozzle inside the pressure chamber and discharges ink out of the pressure chamber; and at least one discharge path that communicates with the pressure chamber at a position apart from the nozzle inside the pressure chamber and discharges ink out of the pressure chamber.

In an embodiment, a plurality of the discharge paths is provided per pressure chamber.

In an embodiment, the discharge path communicates with the pressure chamber near an end apart from the nozzle inside the pressure chamber.

In an embodiment, a flow path resistance of the discharge path is equal to or less than a flow path resistance of the nozzle-part discharge path.

In an embodiment, an average cross-sectional area of the discharge path is equal to or larger than an average cross-sectional area of the nozzle-part discharge path.

In an embodiment, the nozzle-part discharge path and the discharge path are formed in a nozzle plate provided with the nozzle.

In an embodiment, the nozzle-part discharge path and the discharge path communicate with a common flow path.

In an embodiment, a plurality of the pressure chambers is arranged in series, and two partition walls in an arrangement direction of each pressure chamber are piezoelectric elements that are the pressure generation means.

In an embodiment, a plurality of the pressure chambers is arranged in series, and two partition walls in an arrangement direction of each pressure chamber are piezoelectric elements that are the pressure generation means, the ink jet head has pseudo pressure chambers arranged together with the pressure chambers and positioned on both sides of the pressure chambers, the pseudo pressure chambers causing a volume fluctuation in accordance with a volume fluctuation in the pressure chambers, and the discharge path and the nozzle-part discharge path communicate with the pseudo pressure chambers.

In an embodiment, a plurality of the pressure chambers is arranged in series, and two partition walls in an arrangement direction of each pressure chamber are piezoelectric elements that are the pressure generation means, the ink jet head has pseudo pressure chambers and air chambers arranged together with the pressure chambers and configured to cause a volume fluctuation in accordance with a volume fluctuation in the pressure chambers, the nozzle-part discharge path and the discharge path communicate with the pseudo pressure chambers, and the air chambers are sealed.

In an embodiment, an inner length of each of the pressure chambers in a direction orthogonal to the arrangement direction of each pressure chamber and to an ink ejection direction is larger than an inner length of the pressure chamber in the arrangement direction.

In an embodiment, a cross-sectional area of each of the pseudo pressure chambers perpendicular to the nozzle is larger than a cross-sectional area of the pressure chamber.

In an embodiment, an ink jet recording apparatus includes:

the ink jet head;

an ink tank in which ink to be transferred to the ink jet head is stored; and an ink transfer unit that transfers ink inside the ink tank to the ink jet head.

In an embodiment, an ink jet recording apparatus includes:

the ink jet head;

an ink tank in which ink to be transferred to the ink jet head is stored; and an ink transfer unit that transfers ink inside the ink tank to the ink jet head and collects ink transferred to the ink jet head, such that ink discharged from the pressure chamber through the nozzle-part discharge path or the discharge path joins ink collected from the ink jet head.

Advantageous Effects of Invention

The present invention can provide an ink jet head and an ink jet recording apparatus capable of satisfactorily removing remaining air bubbles from a pressure chamber.

DESCRIPTION OF EMBODIMENTS

Hereinafter, embodiments of the present invention will be described in detail using the drawings.

[Ink Jet Recording Apparatus]

Figure 1:
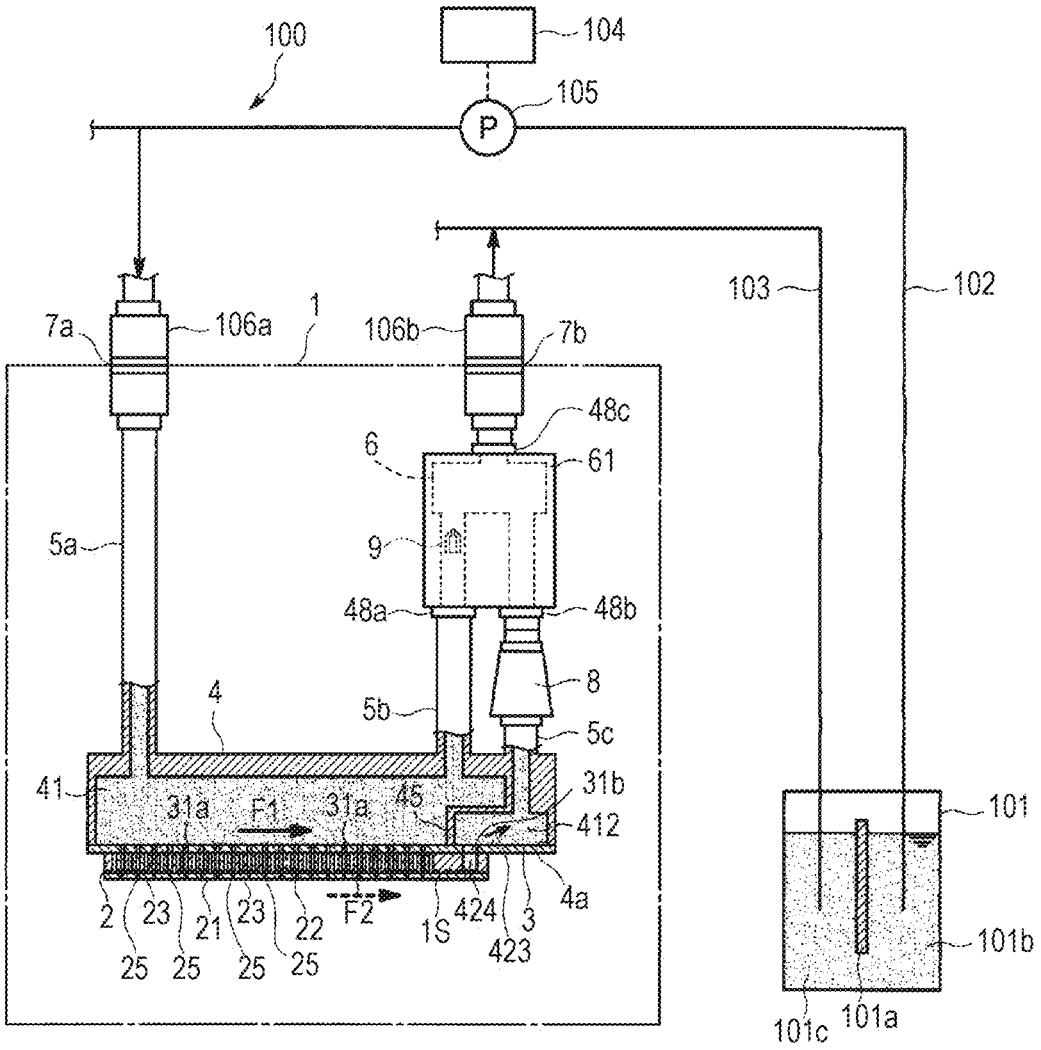
FIG. 1 is a schematic configuration diagram illustrating the essential part of an example of an ink jet recording apparatus according to the present invention.

FIG. 1 is a schematic configuration diagram illustrating the essential part of an example of an ink jet recording apparatus according to the present invention, where an ink jet head is illustrated in a partial cross section.

The ink jet recording apparatus 100 ejects ink from the ink jet head 1 onto a recording medium conveyed in a certain direction (sub scanning direction) by conveying means (not illustrated) to record an image. In what is called a one-pass type ink jet recording apparatus, the ink jet head 1 is fixedly disposed and ejects ink toward a recording medium through nozzles 22 in a process of conveying the recording medium. In what is called a scan-type ink jet recording apparatus, the ink jet head 1 is mounted on a carriage (not illustrated) and ejects ink toward a recording medium through the nozzles 22 in a process in which the carriage moves along the main scanning direction orthogonal to the sub scanning direction.

In FIG. 1, only one ink jet head 1 is illustrated, but in general, the ink jet recording apparatus 100 is provided with a plurality of ink jet heads 1 for various color inks such as yellow (Y), magenta (M), cyan (C), and black (K). In the ink jet recording apparatus 100 according to the present embodiment, an ink tank 101 for storing ink and a common ink chamber 41 of the ink jet head 1 communicate with each other through an ink transfer pipe 102 and an ink return pipe 103.

In the middle of the ink transfer pipe 102, a transfer pump 105 is provided to be driven and controlled by a control unit 104 of the ink jet recording apparatus 100. As the transfer pump 105 is driven, the ink in the ink tank 101 is transferred to the ink jet head 1 via the ink transfer pipe 102. Further, as the transfer pump 105 is driven, the ink in the ink jet head 1 is returned to the ink tank 101 via the ink return pipe 103. In the ink jet recording apparatus 100, the ink transfer pipe 102, the control unit 104, and the transfer pump 105 constitute an ink transfer unit that transfers the ink from the ink tank 101 to the ink jet head 1.

The ink tank 101 is preferably, but not necessarily, partitioned into an ink transfer chamber 101*b* and an ink return chamber 101*c* by a partition plate 101*a* which does not reach the bottom of the tank. In this case, one end of the ink transfer pipe 102 is disposed in the ink transfer chamber 101*b*, and one end of the ink return pipe 103 is disposed in the ink return chamber 101*c*. The partition plate 101*a* is provided to sufficiently degas the ink so that air bubbles contained in the ink returned to the ink return chamber 101*c* do not flow into the ink transfer pipe 102 again. Since air bubbles themselves have high buoyancy, air bubbles are prevented from passing through the lower side of the partition plate 101*a* to flow into the ink transfer chamber 101*b*. Such a mode is a preferable mode for recycling ink.

[Ink Jet Head]

Next, a specific configuration of the ink jet head 1 according to the present invention illustrated in FIG. 1 will be described.

The present invention can be applied to various ink jet heads such as a shear mode (edge (end) shooter or side shooter) type, a bend mode type, and what is called a MEMS type. That is, the ink jet head according to the present invention can be configured as one of these various ink jet heads.

The ink jet head 1 according to the present embodiment is configured as a shear mode head. The ink jet head 1 is installed and used with its ink ejection surface 1S facing downward in the vertical direction. In the present specification, "upper" and "lower" mean "upper side in the vertical direction" and "lower side in the vertical direction", which respectively correspond to the upper side and the lower side of the side view of the use state illustrated in FIG. 1. However, the use state of the ink jet head according to the present invention is not limited to the state in which the ink ejection surface 1S faces downward in the vertical direction, and the ink jet head may be tilted.

As illustrated in FIG. 1, the ink jet head 1 includes an ink manifold 4 constituting the common ink chamber 41, a wiring board 3 bonded to the ink manifold 4, and a head chip 2 bonded to the other surface (lower surface) of the wiring board 3 that is not bonded to the ink manifold 4.

The wiring board 3 is, for example, a glass substrate. On this wiring board 3, a wiring pattern (not illustrated) connected to a power supply circuit (not illustrated) via an FPC board is formed. The ink manifold 4 is made of a synthetic resin or the like and has a horizontally elongated box shape including an opening 4*a* in the lower surface thereof. The opening 4*a* in the ink manifold 4 is closed by the wiring board 3 bonded to the lower surface of the ink manifold 4. The internal space of the ink manifold 4 is the common ink chamber 41 in which the ink supplied from the ink tank 101 is stored.

In the head chip 2, a plurality of pressure chambers (ink channels) 23 and a plurality of pseudo pressure chambers (dummy channels) 25 are formed. The pressure chambers 23 communicate with the common ink chamber 41 via injection holes 31*a*, and cause a volume fluctuation when a voltage is applied from the power supply circuit (not illustrated) via the wiring pattern of the FPC board and the wiring board 3. The pseudo pressure chambers 25 are positioned on both sides of at least the pressure chamber 23, and cause a volume fluctuation in accordance with a volume fluctuation in the adjacent pressure chamber 23. In this embodiment, the pressure chambers 23 and the pseudo pressure chambers 25 are alternately arranged, so that the pseudo pressure chambers 25 are positioned on both sides of the pressure chamber 23. That is, the pressure chambers 23 and the pseudo pressure chambers 25 are set as one unit of "pseudo pressure chamber 25-pressure chamber 23", and a plurality of units is arranged.

Figure 2:
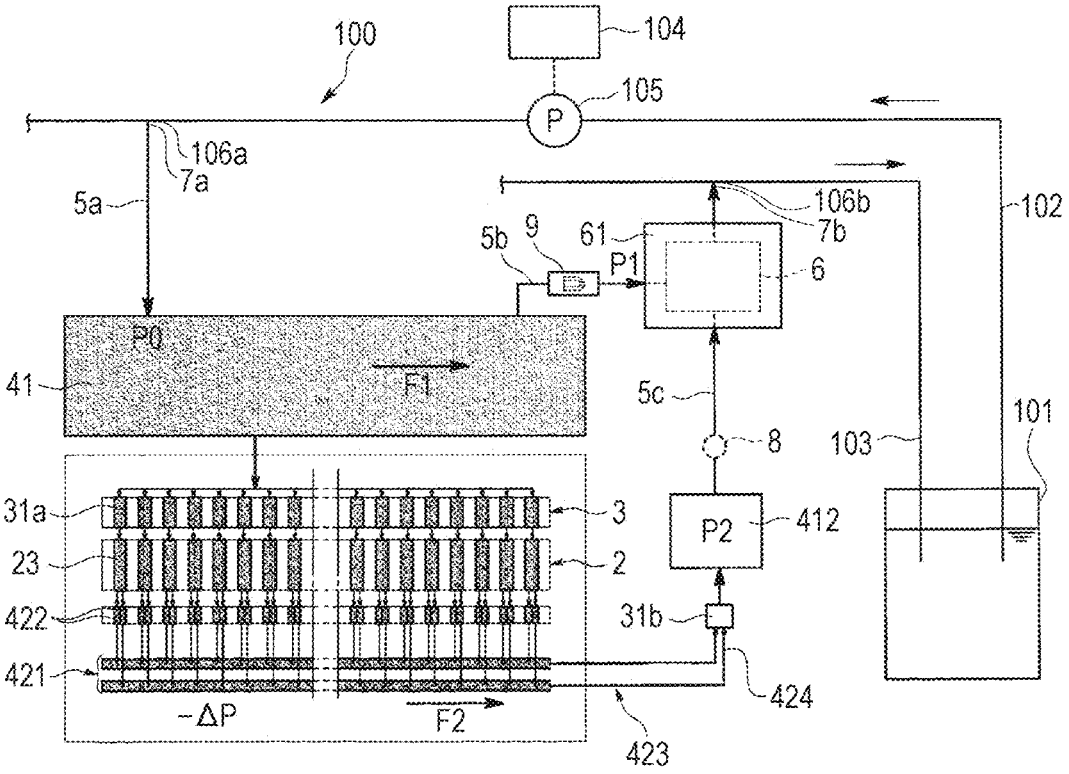
FIG. 2 is a flow path diagram illustrating a flow path of ink in an ink jet head according to the present invention.

FIG. 2 is a flow path diagram illustrating a flow path of ink in the ink jet head.

As illustrated in FIG. 1 and FIG. 2, the common ink chamber 41 is linked to an ink supply pipe 5*a* serving as a flow path for supplying ink into the common ink chamber 41. The ink supply pipe 5*a* communicates with the common ink chamber 41 on the side (upper side) far from the pressure chambers (ink channels) 23. On the upper end side of the ink supply pipe 5*a*, a connecting portion 7*a* is provided. The connecting portion 7*a* is detachably connected to a connecting portion 106*a* of the ink jet recording apparatus 100. The connecting portion 106*a* of the ink jet recording apparatus 100 communicates with the ink transfer pipe 102. As a result, ink can be transferred from the ink jet recording apparatus 100 to the ink jet head 1.

In the common ink chamber 41, an ink collection pipe 5*b* serving as a flow path for collecting ink from the common ink chamber 41 is provided. The ink collection pipe 5*b* communicates with the common ink chamber 41 on the side (upper side) far from the pressure chambers 23. On the upper end side of the ink collection pipe 5*b*, a connecting portion 7*b* is provided. The connecting portion 7*b* is detachably connected to a connecting portion 106*b* of the ink jet recording apparatus 100. The connecting portion 106*b* of the ink jet recording apparatus 100 communicates with the ink return pipe 103. As a result, ink can be returned from the ink jet head 1 to the ink jet recording apparatus 100.

In this ink jet head 1, the flow path extending from the ink supply pipe 5*a* to a buffer space 6 (described later) in the middle of the ink collection pipe 5*b* is referred to as a main flow path F1.

It is preferable that the ink supply pipe 5*a* and the ink collection pipe 5*b* be disposed apart from each other at the two longitudinal ends of the common ink chamber 41. In the present embodiment, the ink supply pipe 5*a* is disposed at the left end in FIG. 1 on the upper surface of the ink manifold 4, and the ink collection pipe 5*b* is disposed at the right end in FIG. 1 on the upper surface of the ink manifold 4. As a result, the ink supplied from the ink supply pipe 5*a* to the common ink chamber 41 can flow throughout the common ink chamber 41 toward the ink collection pipe 5*b*. Therefore, ink is unlikely to remain in a specific part of the common ink chamber 41, so that air bubbles in the ink can be removed more efficiently.

In the ink manifold 4, an ink discharge chamber 412 is provided adjacent to the common ink chamber 41. The ink discharge chamber 412 is separated from the common ink chamber 41 by a partition wall 45. The partition wall 45 can be formed integrally with the ink manifold 4.

Figure 3:
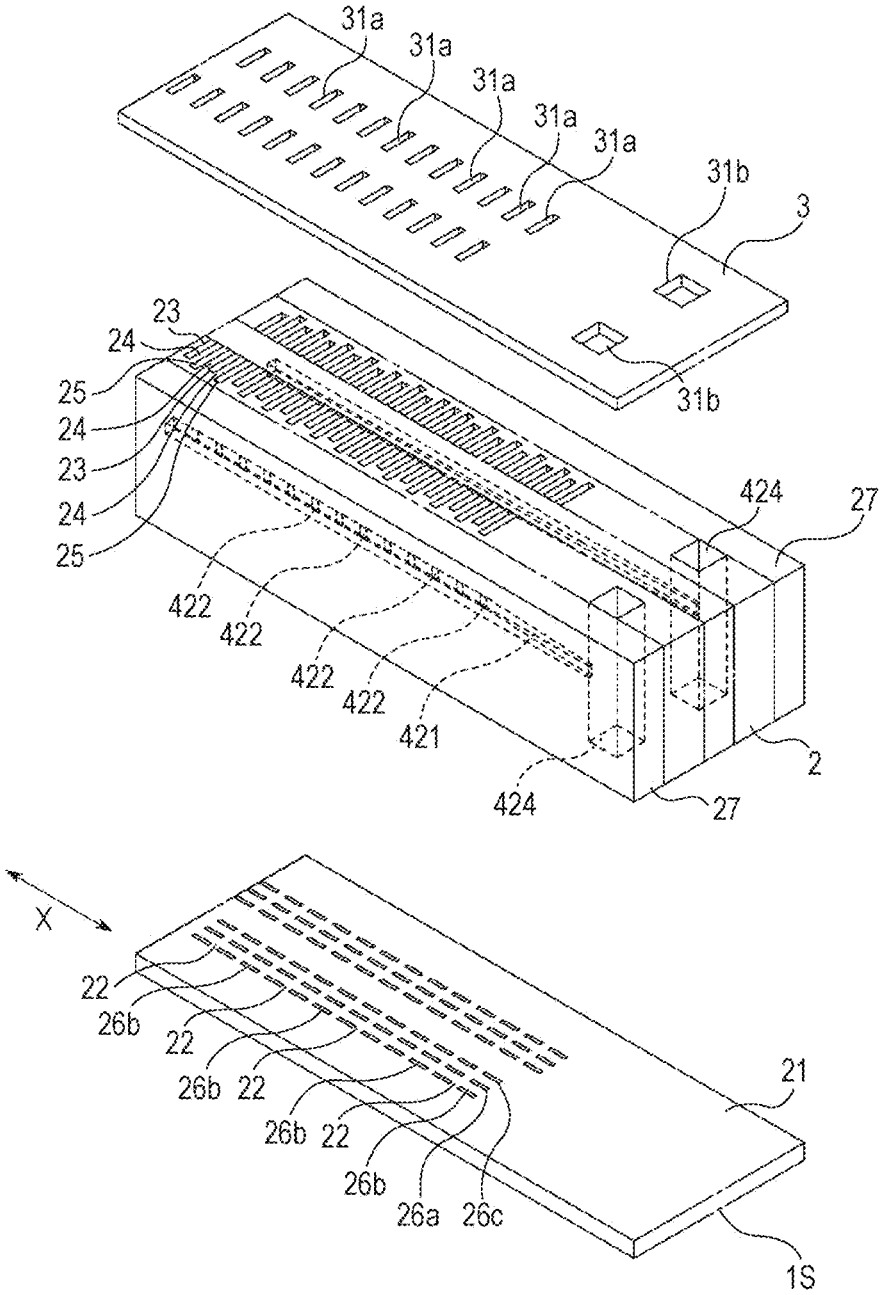
FIG. 3 is a perspective view of a head chip of the ink jet head illustrated in FIG. 1.

FIG. 3 is a perspective view of the head chip of the ink jet head illustrated in FIG. 1.

Figure 4:
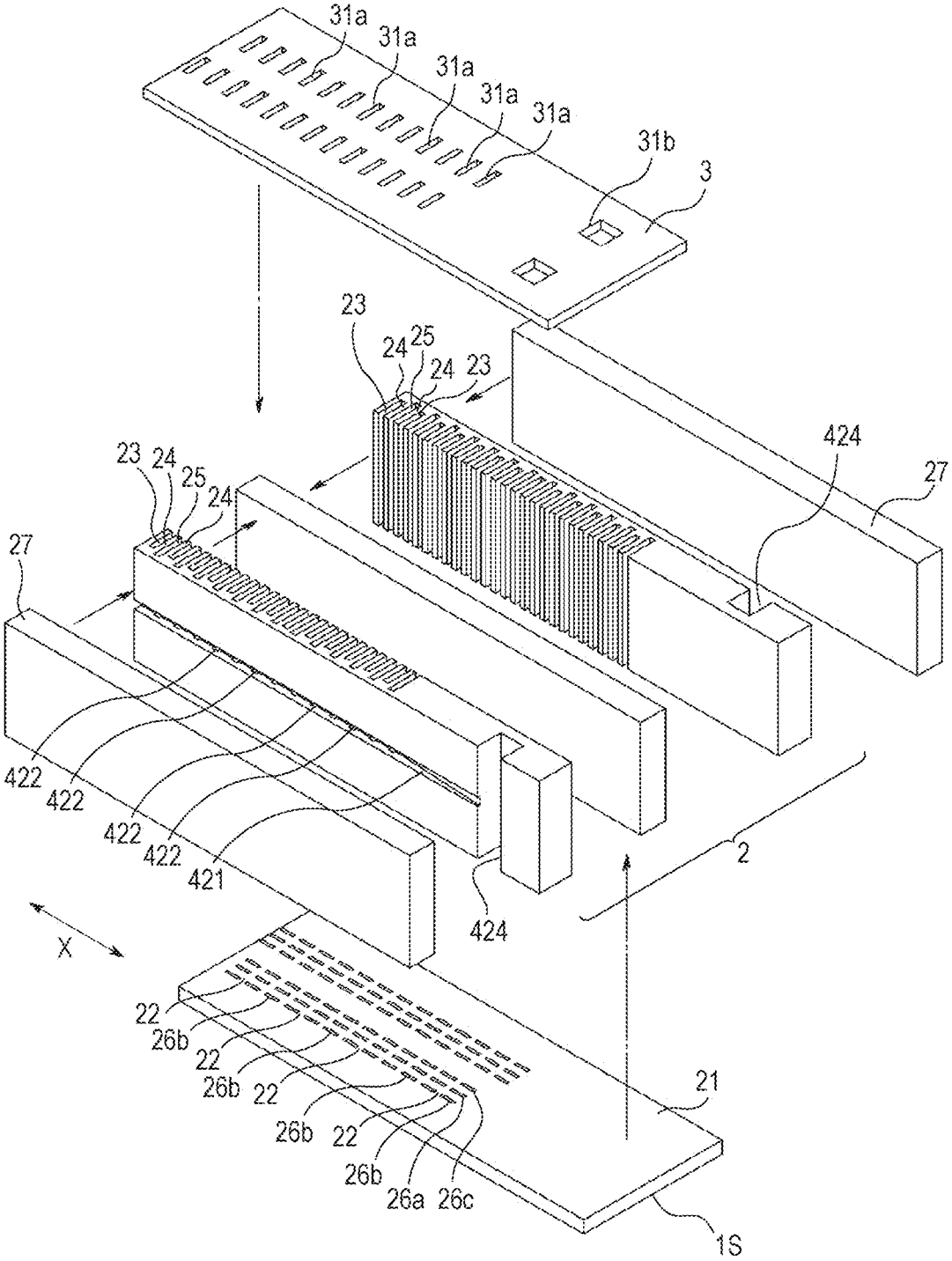
FIG. 4 is an exploded perspective view of the head chip of the ink jet head illustrated in FIG. 1.

FIG. 4 is an exploded perspective view of the head chip of the ink jet head illustrated in FIG. 1.

As described above, the plurality of pressure chambers 23 and the plurality of pseudo pressure chambers 25 are formed in the head chip 2 as illustrated in FIG. 3 and FIG. 4. Each of the pressure chambers 23 includes a pair of piezoelectric elements (drive walls) 24, 24, or a pair of pressure generation means. Two (a pair of) piezoelectric elements 24, 24 are provided per pressure chamber 23 to form two walls of each pressure chamber 23. There is a gap between the piezoelectric elements 24 constituting one pressure chamber 23 and the piezoelectric elements 24 constituting the adjacent pressure chamber 23. This gap is one of the pseudo pressure chambers 25. Therefore, each pressure chamber 23 can be independently driven (expanded or contracted).

The ink jet head 1 does not necessarily include the pseudo pressure chambers 25, and adjacent pressure chambers 23, 23 may share a single drive wall 24. In this case, since each pressure chamber 23 cannot be independently driven (expanded or contracted), what is called three-cycle driving is performed.

The pressure chambers 23 communicate with the common ink chamber 41 via the injection holes 31*a* formed in the wiring board 3. The ink in the common ink chamber 41 is injected into the pressure chambers 23 via the injection holes 31*a*. Each pressure chamber 23 causes a volume fluctuation due to the application of voltage to the piezoelectric elements 24. Further, a nozzle plate 21 provided with the plurality of nozzles 22 corresponding to the respective pressure chambers 23 is bonded to the surface (lower surface) of the head chip 2 farthest from the wiring board 3. The nozzles 22 allow the pressure chambers 23 to communicate with the outside (downward). The lower surface of the nozzle plate 21 serves as the ink ejection surface 1S. The ink in each pressure chamber 23 is subjected to an ejection pressure by the action of the piezoelectric elements 24, and ejected toward the outer (downward) recording medium through the nozzle 22. That is, each nozzle 22 serves as a flow path of ink ejected outward (downward) from the corresponding pressure chamber 23.

Means for applying an ejection pressure to the ink in each pressure chamber 23 is not limited, and various types of known means can be adopted. In the present embodiment, as illustrated in FIG. 3 and FIG. 4, adjacent pressure chambers 23, 23 are separated by the piezoelectric elements 24, 24 and the quasi pressure chamber 25. For example, by applying a predetermined drive voltage from the control unit 104 via a wiring (not illustrated) formed on the wiring board 3 to a drive electrode (not illustrated) formed on the surface of each piezoelectric element 24 facing the interior of the pressure chamber 23, the piezoelectric element 24 undergoes shear deformation. The piezoelectric elements 24, 24 on both sides of the pressure chamber 23 undergo shear deformation, whereby the inside of the pressure chamber 23 is expanded or contracted. As a result, pressure is applied to the ink in the pressure chamber 23, and ink is ejected through the nozzle 22.

The number of the pressure chambers 23 formed in the head chip 2 is not limited. In the head chip 2 illustrated in the present embodiment, the plurality of pressure chambers 23 is arranged in a plurality of rows along the X direction in FIGS. 3 and 4 which is the longitudinal direction of the head chip 2.

Figure 5:
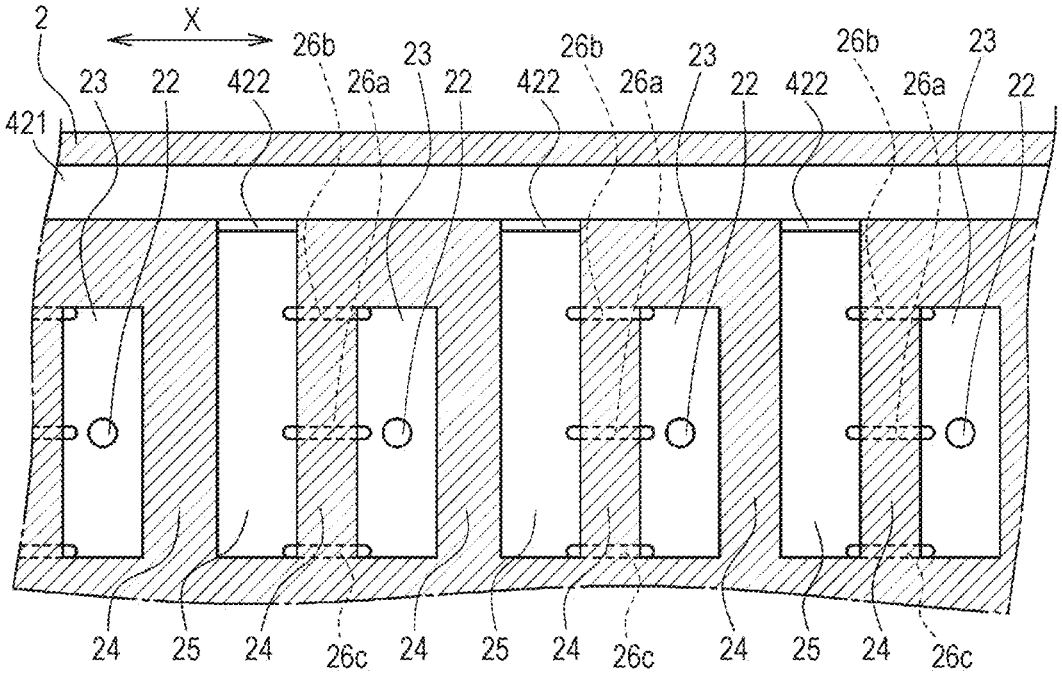
FIG. 5 is an enlarged plan view conceptually illustrating a structure of the head chip of the ink jet head illustrated in FIG. 1.

FIG. 5 is an enlarged plan view conceptually illustrating a structure of the head chip of the ink jet head illustrated in FIG. 1.

As illustrated in FIGS. 3 to 5, each pressure chamber 23 and the pseudo pressure chamber 25 adjacent to one side thereof communicate with each other through a nozzle-part discharge path 26*a* and two discharge paths 26*b*, 26*c*. The nozzle-part discharge path 26*a* communicates with the pressure chamber 23 near the nozzle 22 inside the pressure chamber 23, discharges ink out of the pressure chamber 23 to the pseudo pressure chamber 25, and discharges remaining air bubbles. The discharge paths 26*b*, 26*c* communicate with the pressure chamber 23 at positions apart from the nozzle 22 inside the pressure chamber 23, discharge ink out of the pressure chamber 23 to the pseudo pressure chamber 25, and discharge remaining air bubbles.

In the present embodiment, the nozzle-part discharge path 26*a* and the discharge paths 26*b*, 26*c* are grooves formed on the upper surface of the nozzle plate 21, corresponding to each pressure chamber 23, and reaching the pseudo pressure chamber 25 adjacent to one side of the pressure chamber 23. This nozzle plate 21 is attached to the head chip 2 to form a flow path.

In the present embodiment, the nozzle-part discharge path 26*a* and the discharge paths 26*b*, 26*c* communicating with one pressure chamber 23 communicate with the same pseudo pressure chamber 25, and thus have equal fluctuations in flow path resistance, so that remaining air bubbles can be steadily discharged.

As described above, the discharge paths 26*b*, 26*c* are formed by grooves in the nozzle plate 21 such that the discharge paths 26*b*, 26*c* are located in a part (lower side) of the pressure chamber 23 close to the nozzle plate 21. Therefore, the discharge paths 26*b*, 26*c* can form a flow path extending over the entire pressure chamber 23 in the depth direction. Thus, air bubbles remaining near the end of the pressure chamber 23 can be satisfactorily removed. In this case, the nozzle-part discharge path 26*a* and the discharge paths 26*b*, 26*c* can be formed by processing only the nozzle plate 21, and thus are easy to manufacture. However, the positions of the discharge paths 26*b*, 26*c* are not limited to these positions. The discharge paths 26*b*, 26*c* may be formed by grooves in the upper surface of the head chip 2 and/or the lower surface of the wiring board 3 such that the discharge paths 26*b*, 26*c* are located in a part (upper side) of the pressure chamber 23 close to the wiring board 3.

It is preferable that the discharge paths 26*b*, 26*c* communicate with the pressure chamber 23 near the two longitudinal ends of the pressure chamber 23. This is because air bubbles often remain near the two longitudinal ends of the pressure chamber 23. Therefore, it is more preferable that the discharge paths 26*b*, 26*c* communicate with the pressure chamber 23 at the two longitudinal ends of the pressure chamber 23.

The inner length of each pressure chamber 23 in the direction orthogonal to the arrangement direction (X direction in the drawings) and to the ink ejection direction (axial direction of the nozzle 22) is larger than the inner length of that pressure chamber 23 in the arrangement direction. The opening sectional shape of each pressure chamber 23 is a rectangle. Therefore, the position of communication from the pressure chamber 23 to each of the discharge paths 26*b*, 26*c* can be provided on the long side of the opening sectional shape of the pressure chamber 23, and it is easy to provide a plurality of positions of communication.

The cross-sectional area of each pseudo pressure chamber 25 perpendicular to the nozzle 22 is larger than the cross-sectional area of the pressure chamber 22. Therefore, the position of communication from the pseudo pressure chamber 25 to each of the discharge paths 26*b*, 26*c* can be provided in a wider area than the position of communication from the pressure chamber 23 to each of the discharge paths 26*b*, 26*c*. Thus, the discharge paths 26*b*, 26*c* extending from the pressure chamber 23 to the pseudo pressure chamber 25 can reach the pseudo pressure chamber 25 even if there is a certain error in the position and direction of each discharge path 26*b*, 26*c*.

Note that the total of the flow path resistances of the nozzle-part discharge paths 26*a* and the discharge paths 26*b*, 26*c* is prescribed in consideration of conditions such as the pressure applied by the transfer pump 105 so as not to cause a meniscus break from the nozzles 22. The opening area and the length of each of the nozzle-part discharge paths 26*a* and the discharge paths 26*b*, 26*c* can be appropriately set as long as the total of the flow path resistances thereof does not deviate from the prescribed value.

It is preferable that the total of the flow path resistances of the discharge paths 26*b*, 26*c* be equal to or less than the total of the flow path resistances of the nozzle-part discharge paths 26*a*. For that purpose, it is preferable that the average cross-sectional area of the discharge paths 26*b*, 26*c* be equal to or larger than the average cross-sectional area of the nozzle-part discharge paths 26*a*. Since the flow path resistance of each discharge path 26*b*, 26*c* is low, each discharge path 26*b*, 26*c* discharges more ink than each nozzle-part discharge path 26*a*, and remaining air bubbles near the two ends of the pressure chamber 23 can be satisfactorily discharged.

Figure 6A:
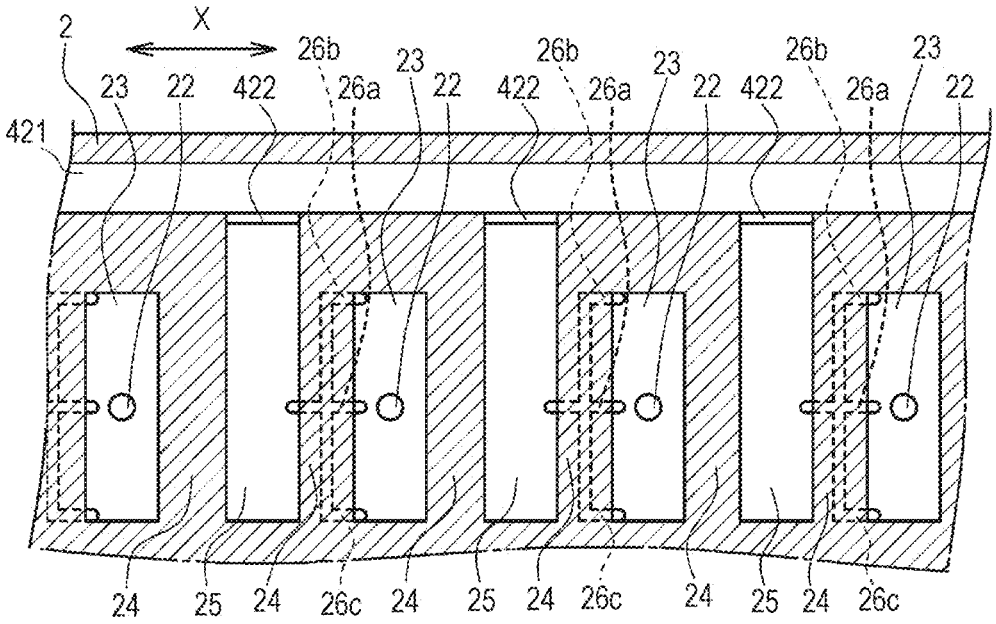
FIG. 6 is an enlarged plan view conceptually illustrating other example structures of the head chip of the ink jet head.
Figure 6B:
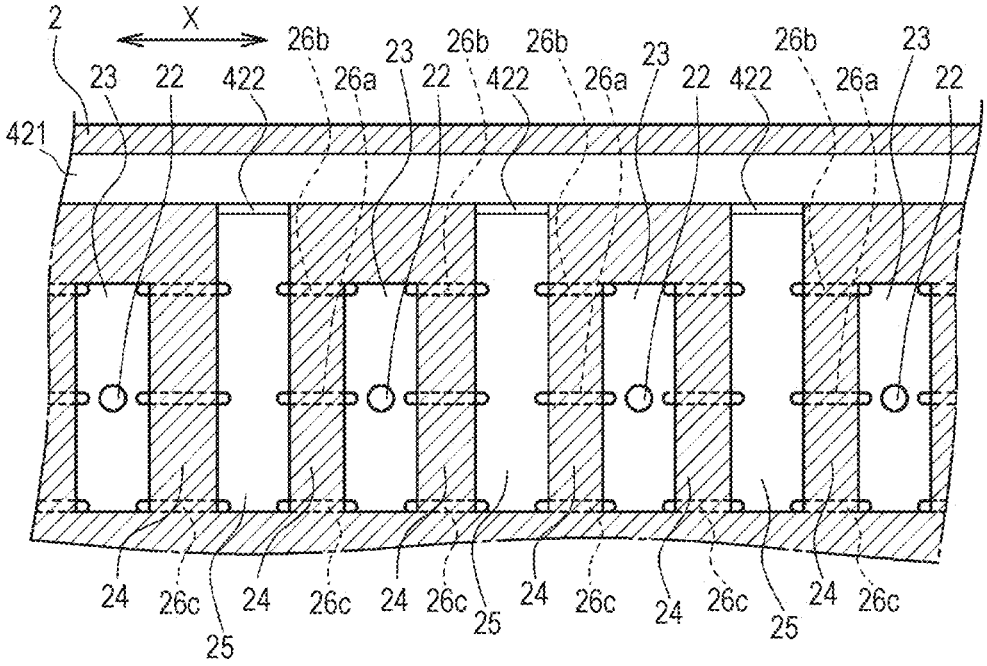

FIG. 6A and FIG. 6B are enlarged plan views conceptually illustrating other example structures of the head chip of the ink jet head.

As illustrated in FIG. 6A, the nozzle-part discharge path 26*a* and the discharge paths 26*b*, 26*c* may be formed such that they are joined together to reach the pseudo pressure chamber 25.

Alternatively, as illustrated in FIG. 6(*b*), any or all of the nozzle-part discharge path 26*a* and the discharge paths 26*b*, 26*c* may be formed such that they extend from each pressure chamber 23 to the two adjacent pseudo pressure chambers 25, 25.

In the embodiment described above, two discharge paths are provided per pressure chamber, but only one discharge path may be provided per pressure chamber 23. However, it is preferable to provide a plurality of discharge paths per pressure chamber as long as the total of the flow path resistances of nozzle-part discharge paths and discharge paths does not deviate from the prescribed value. Increasing the number of discharge paths and the number of directions of discharge paths provided per pressure chamber raises the probability that when one of the discharge paths is clogged, at least one discharge path can still discharge ink, which can increase the reliability of discharging remaining air bubbles.

Figure 7:
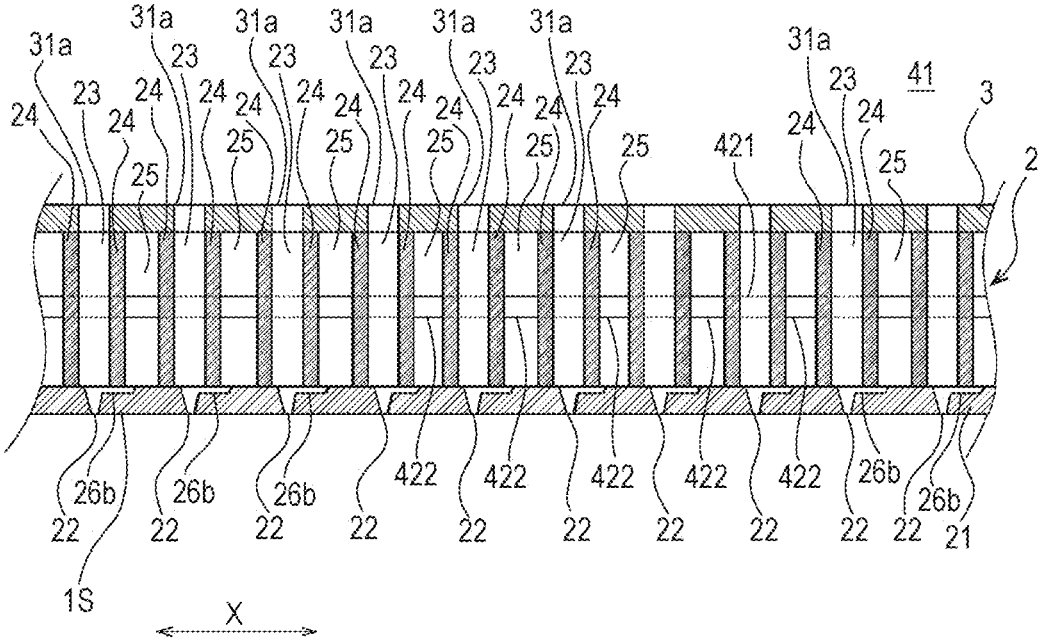
FIG. 7 is an enlarged sectional view of the head chip of the ink jet head illustrated in FIG.

FIG. 7 is an enlarged sectional view of the head chip of the ink jet head illustrated in FIG. 1.

As illustrated in FIG. 7, an individual communication path 422 is formed in communication with the side of each pseudo pressure chamber 25. These individual communication paths 422 are formed in the head chip 2. These individual communication paths 422 communicate with and join a common flow path 421. The common flow path 421 is a groove cut in the side surface of the head chip 2 in the arrangement direction (X direction) of the pressure chambers 23, and a lid member 27 is attached to the side surface of the head chip 2, whereby a flow path is formed. As described above, the cross-sectional area of each pseudo pressure chamber 25 perpendicular to the nozzle 22 is larger than the cross-sectional area of the pressure chamber 22. Therefore, the common flow path 421 formed in communication with the side of each pseudo pressure chamber 25 does not communicate with the side of each pressure chamber 22.

An end of the common flow path 421 communicates with a discharge channel 424 formed in the head chip 2. The discharge channel 424 is formed on one longitudinal end side of the head chip 2 and is positioned below the ink discharge chamber 412. In this way, the space from each injection hole 31*a* through the nozzle-part discharge path 26*a* and the discharge paths 26*b*, 26*c* to the pseudo pressure chamber 25 is in communication with the discharge channel 424.

Part of the ink injected from each injection hole 31*a* into the pressure chamber 23 reaches the pseudo pressure chamber 25 through the nozzle-part discharge path 26*a* and the discharge paths 26*b*, 26*c*, and further passes through the individual communication path 422 to reach the common flow path 421. Then, the ink that has reached the common flow path 421 passes through the discharge channel 424 and a discharge hole 31*b* formed in the wiring board 3, and reaches the ink discharge chamber 412.

In a case where the pseudo pressure chambers 25 are not provided, the nozzle-part discharge path 26*a* and the discharge paths 26*b*, 26*c* communicate with the common flow path 421. The ink that has reached the common flow path 421 through the nozzle-part discharge path 26*a* and the discharge paths 26*b*, 26*c* passes through the discharge channel 424 and the discharge hole 31*b* formed in the wiring board 3 to reach the ink discharge chamber 412. In this case, as mentioned in the above description, the nozzle-part discharge path 26*a* and the discharge paths 26*b*, 26*c* communicating with one pressure chamber 23 communicate with the same common flow path 421, and thus have equal fluctuations in flow path resistance, so that remaining air bubbles can be steadily discharged.

In this ink jet head 1, the individual communication paths 422 and the common flow path 421 provided in the head chip 2 serve as ink flow paths in the head, and these ink flow paths allow remaining air bubbles in each pressure chamber 23 to be satisfactorily discharged. Therefore, normal ejection operation can be secured.

In this ink jet head 1, a flow path is formed from each pressure chamber 23 through each pseudo pressure chamber 25, each individual communication path 422, and the common flow path 421 to the ink discharge chamber 412. Therefore, conditions such as the pressure applied by the transfer pump 105 are determined in consideration of the sum of the flow path resistances of them so as not to cause a meniscus break from the nozzles 22 under the conditions.

As illustrated in FIG. 1 and FIG. 2, an ink discharge pipe 5*c* serving as a flow path for discharging ink from the ink discharge chamber 412 is connected to the ink discharge chamber 412. The upper end side of the ink discharge pipe 5*c* joins the ink collection pipe 5*b*. The ink collection pipe 5*b* and the ink discharge pipe 5*c* join by being connected to a junction box 61.

The junction box 61 is integrally formed from a synthetic resin material or a metal material, and the buffer space 6 is formed therein. First to third openings 48*a*, 48*b*, 48*c* leading to the buffer space 6 are formed in the outer surface of the junction box 61. The flow path extending from the first opening 48*a* via the buffer space 6 to the third opening 48*c* is interposed in the middle of the ink collection pipe 5*b*. According to an implementation, the ink collection pipe 5*b* is divided into the upstream side and the downstream side in the middle portion, the upstream side is connected to the first opening 48*a*, and the downstream side is connected to the third opening 48*c*. Then, the ink discharge pipe 5*c* is connected to the second opening 48*b*.

As described above, in the ink jet head 1 according to the present embodiment, the ink collection pipe 51*b* and the ink discharge pipe 51*c* join in the junction box 61. Therefore, the ink jet head 1 is connected to the pipes of the ink jet recording apparatus 100 only at two positions, i.e., the ink supply pipe 51*a* (connecting portion 7*a*) and the ink collection pipe 51*b* (connecting portion 7*b*). Therefore, the number of positions of connection with the pipes of the ink jet recording apparatus 100 is equal to that of a general ink jet head, which means that the connecting operation is not complicated.

In addition, the ink jet head 1 according to the present embodiment is connected to the connecting portions 106*a*, 106*b* of the ink jet recording apparatus 100 only at two positions, i.e., the ink supply pipe 51*a* (connecting portion 7*a*) and the ink collection pipe 51*b* (connecting portion 7*b*). Therefore, the ink jet head 1 is compatible with an ink jet head for an existing ink jet recording apparatus equipped with a circulation mechanism. Specifically, in general, an ink jet recording apparatus having a circulation mechanism for circulating ink in the ink manifold 4 is structured to be connected through pipes to each ink jet head at two positions: an ink supply section and an ink collection section. Therefore, the ink jet head 1 according to the present embodiment can be replaced and installed by being connected at just two positions: the connecting portions 7*a*, 7*b*, without the need for changing the design of the existing device.

In the ink jet head 1, the flow path leading to the buffer space 6 through the nozzle-part discharge path 26*a* and the discharge paths 26*b*, 26*c*, the individual communication path 422, the common flow path 421, the discharge channel 424, the discharge hole 31*b*, the ink discharge chamber 412, and the ink discharge pipe 5*c* is referred to as a discharge flow path 423. The discharge flow path 423 is a flow path that communicates with the pressure chamber 23, discharges ink out of the pressure chamber 23, and joins the ink collection pipe 5*b* in the buffer space 6. The flow path extending from each injection hole 31*a* to the discharge flow path 423 (from the nozzle-part discharge path 26*a* and the discharge paths 26*b*, 26*c* to the entrance to the buffer space 6) is referred to as a sub flow path F2 (see FIG. 2).

The discharge flow path 423 is configured as a flow path that passes through all of the nozzle-part discharge path 26*a* and the discharge paths 26*b*, 26*c* corresponding to each pressure chamber 23 and the individual communication path 422 corresponding to each pseudo pressure chamber 25. Therefore, the flow path resistance of the entire discharge flow path 423 increases as the density of the pressure chambers 23 increases. Thus, the ink discharge pipe 5*c* is unlikely to join the ink collection pipe 5*b* smoothly since the flow rate of the main flow path F1 passing through the ink supply pipe 5*a* and the ink collection pipe 5*b* is large, and the flow rate of the sub flow path F2 extending from each injection hole 31*a* to the discharge flow path 423 is small. In the ink jet head 1, however, the main flow path F1 and the sub flow path F2 (the ink discharge pipe 5*c* and the ink collection pipe 5*b*) join in the buffer space 6, and a flow rate adjusting member 9 (described later) and a suction pump are used. Therefore, the main flow path F1 and the sub flow path F2 can join smoothly although the flow rates of the paths are different.

According to the above-mentioned ink jet head 1 and the ink jet recording apparatus 100 including the ink jet head 1, just by supplying ink from the ink supply pipe 5*a*, remaining air bubbles in the common ink chamber 41 can be discharged through the main flow path F1 to the ink collection pipe 5*b*, and air bubbles near the pressure chambers 23 drawn from the nozzles 22 can also be quickly discharged through the sub flow path F2 to the ink discharge pipe 5*c*. Therefore, remaining air bubbles in the entire ink manifold 4 (inside the common ink chamber 41 and near the pressure chambers 23) can be removed efficiently. In addition, even in the case of using ink containing particles, pigments, or the like which are easy to settle, it is possible to effectively suppress sedimentation of particles, pigments, or the like in each of the individual communication paths 422 and the common flow path 421 during image recording, and it is possible to suppress the concentration deviation of ink.

It should be noted that forming the common flow path 421 with a groove cut in the side surface of the head chip 2 as in this embodiment can increase the width of the common flow path 421. This is because the side surface of the head chip 2 has an area that can expand the width of the groove that becomes the common flow path 421 without hindrance. Although there is a structural restriction that the lid member 27 must be attached to the side surface of the head chip 2, increasing the width of the common flow path 421 can achieve the effect of reducing the flow path resistance of the common flow path 421.

Next, configuration examples of the common flow path 421 and the individual communication paths 422 that can be configured without using the lid member 27 will be described with reference to FIG. 8 to FIG. 10.

[Another Embodiment of individual Communication Path and Common Flow Path]

Figure 8:
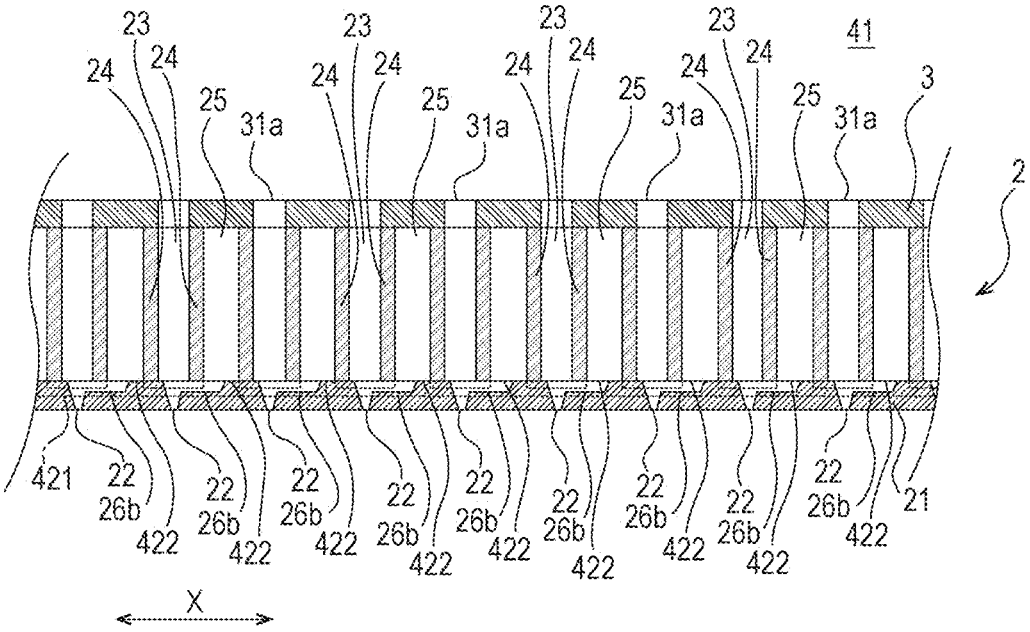
FIG. 8 is an enlarged sectional view illustrating another example of a common flow path and individual communication paths of the ink jet head illustrated in FIG. 1.

FIG. 8 is an enlarged sectional view illustrating another example of the common flow path and the individual communication paths of the ink jet head illustrated in FIG. 1. Since components denoted by the same reference signs as those in FIG. 1 have the same functions as those in FIG. 1, the above description is incorporated herein by reference and will not be repeated here.

In the ink jet head 1, the individual communication paths 422 and the common flow path 421 may be formed by grooves formed on the upper surface of the nozzle plate 21 as illustrated in FIG. 8. In this case, the nozzle plate 21 is bonded to the lower surface of the head chip 2, whereby the individual communication paths 422 and the common flow path 421 are formed.

As in the above-mentioned case, the ink in each pseudo pressure chamber 25 passes through the individual communication path 422, reaches and joins the common flow path 421, and reaches the ink discharge chamber 412 through the discharge channel 424 and the discharge hole 31*b*.

Figure 9:
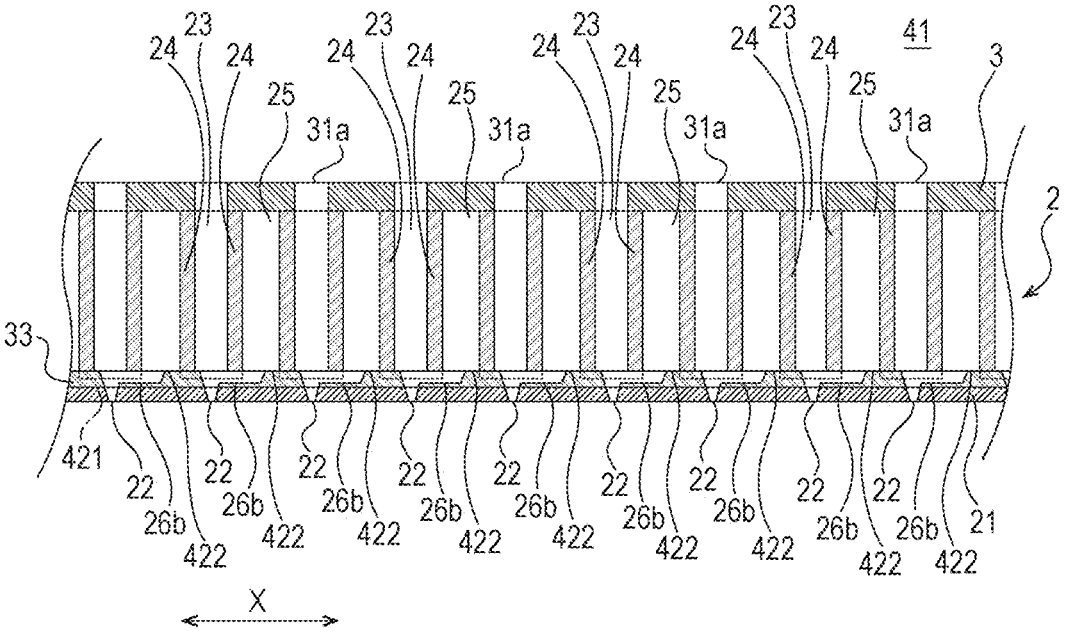
FIG. 9 is an enlarged sectional view illustrating still another example of the common flow path and the individual communication paths of the ink jet head illustrated in FIG. 1.

FIG. 9 is an enlarged sectional view illustrating still another example of the common flow path and the individual communication paths of the ink jet head illustrated in FIG. 1. Since components denoted by the same reference signs as those in FIG. 1 have the same functions as those in FIG. 1, the above description is incorporated herein by reference and will not be repeated here.

In the ink jet head 1, as illustrated in FIG. 9, a flow path plate 33 may be interposed as a plate-shaped spacer member between the head chip 2 and the nozzle plate 21, and the individual communication paths 422 and the common flow path 421 may be formed by grooves formed on the upper surface of the flow path plate 33. In this case, the flow path plate 33 is bonded to the lower surface of the head chip 2, whereby the individual communication paths 422 and the common flow path 421 are formed. The nozzle plate 21 is bonded to the lower surface of the flow path plate 33. In the flow path plate 33, through holes corresponding to the respective nozzles 22 are bored.

Preferable examples of the material of the flow path plate 33 are glass, silicon, stainless steel, polyimide resin, and the like. Glass, stainless steel, and polyimide are advantageous in terms of price (inexpensiveness). Stainless steel and polyimide are advantageous in terms of ease of processing. Silicon is advantageous in terms of processing accuracy. Glass and polyimide are advantageous in terms of chemical stability.

In this case, the nozzle-part discharge path 26*a* and the discharge paths 26*b*, 26*c* can be formed by grooves formed on the upper surface of the flow path plate 33. In this case, the flow path plate 33 is bonded to the lower surface of the head chip 2, whereby the nozzle-part discharge path 26*a* and the discharge paths 26*b*, 26*c* are formed.

Figure 10:
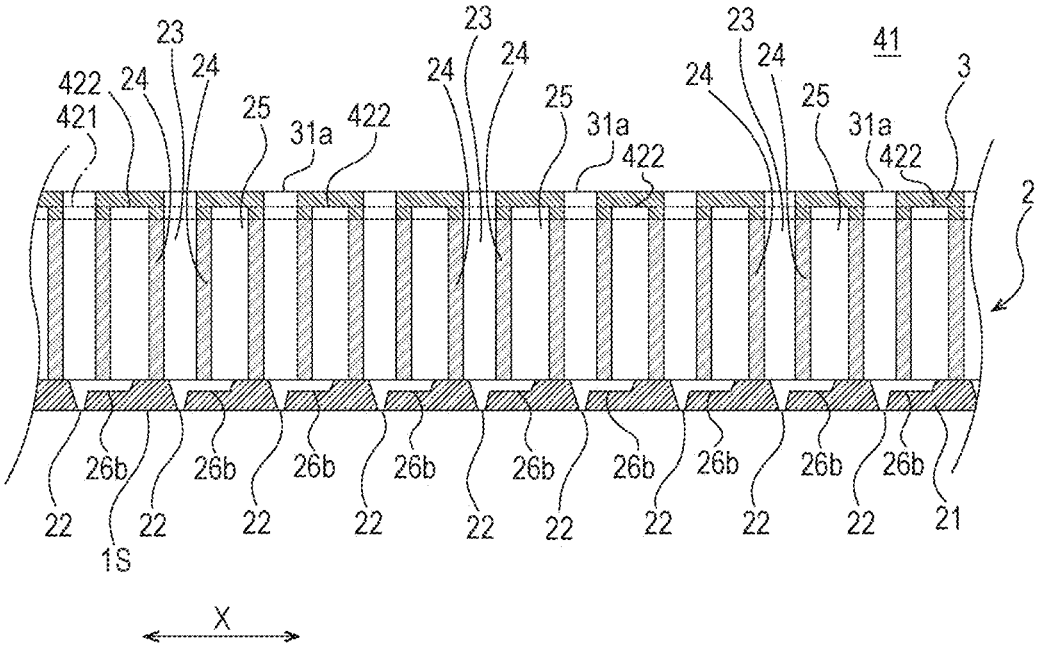
FIG. 10 is an enlarged sectional view illustrating still another example of the common flow path and the individual communication paths of the ink jet head illustrated in FIG. 1.

FIG. 10 is an enlarged sectional view illustrating still another example of the common flow path and the individual communication paths of the ink jet head illustrated in FIG. 1. Since components denoted by the same reference signs as those in FIG. 1 have the same functions as those in FIG. 1, the above description is incorporated herein by reference and will not be repeated here.

In the ink jet head 1, the individual communication paths 422 and the common flow path 421 may be formed by grooves formed on the lower surface of the wiring board 3 (and/or the upper surface of the head chip 2) as illustrated in FIG. 10. In this case, the wiring board 3 is superimposed on the head chip 2, whereby the individual communication paths 422 and the common flow path 421 are formed.

As in the above-mentioned case, the ink in each pseudo pressure chamber 25 passes through the individual communication path 422, reaches and joins the common flow path 421, and reaches the ink discharge chamber 412 through the discharge channel 424 and the discharge hole 31*b*.

Note that the embodiments of the nozzle-part discharge path 26*a* and the discharge paths 26*b*, 26*c* and the embodiments of the individual communication paths 422 and the common flow path 421 mentioned above can be combined to form the ink jet head 1 in any manner that can form flow paths.

[Another Embodiment of Head Chip]

Figure 11:
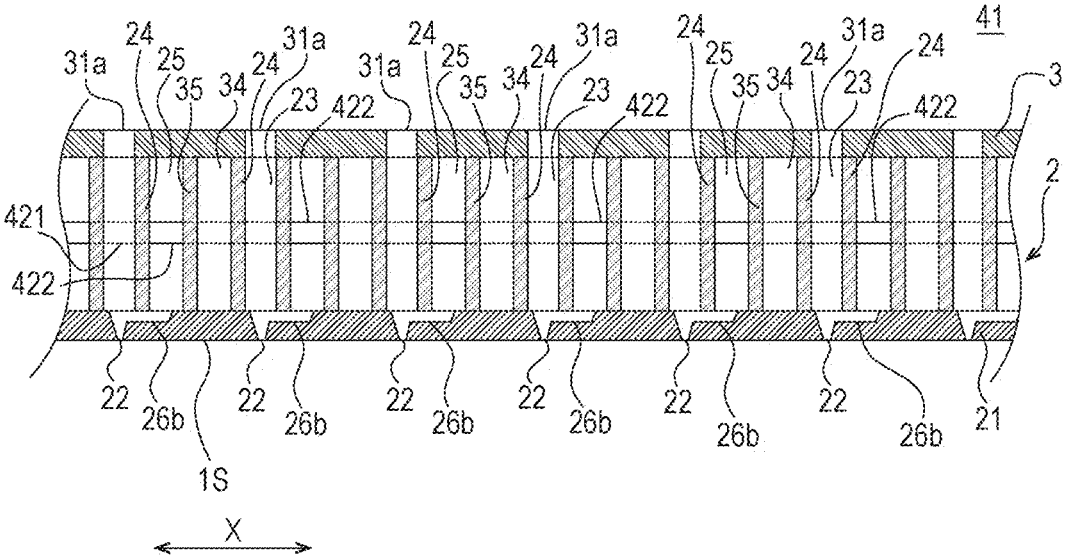
FIG. 11 is an enlarged sectional view illustrating another example of the head chip of the ink jet head illustrated in FIG. 1.

FIG. 11 is an enlarged sectional view illustrating another example of the head chip of the ink jet head illustrated in FIG. 1. Since components denoted by the same reference signs as those in FIG. 1 have the same functions as those in FIG. 1, the above description is incorporated herein by reference and will not be repeated here.

In the ink jet head 1 according to this embodiment, as illustrated in FIG. 11, air chambers 34 that do not communicate with the nozzle-part discharge path 26*a* and the discharge paths 26*b*, 26*c* are arranged together with the pressure chambers 23 and the pseudo pressure chambers 25. The air chambers 34 each form a sealed space in which no ink flows. In this embodiment, the number of air chambers 34 provided between the pressure chambers 23 and the pseudo pressure chambers 25 is the same as the number of pressure chambers 23. That is, "pseudo pressure chamber 25-air chamber 34-pressure chamber 23" is set as one unit, and a plurality of units is arranged.

The air chambers 34 and the pressure chambers 23 are separated by the piezoelectric elements 24. Wall surfaces 35 that separate the air chambers 34 from the pseudo pressure chambers 25 do not have to be deformed, and thus need not necessary be the piezoelectric elements 24. However, the wall surfaces 35 may be integrally formed with the piezoelectric elements 24 using the same material as the piezoelectric elements 24 as long as no voltage is applied to the wall surfaces 35.

The upper side of the air chamber 34 is closed by the wiring board 3, and the lower side of the air chamber 34 is closed by the nozzle plate 21. This air chamber 34 is a closed space because it communicates with neither the nozzle-part discharge path 26*a* and the discharge paths 26*b*, 26*c* nor the common flow path 421. This air chamber 34 reduces crosstalk between the pressure chambers 23.

Note that the number of air chambers 34 provided between the pressure chambers 23 and the pseudo pressure chambers 25 may be double the number of pressure chambers 23. That is, "pseudo pressure chamber 25-air chamber 34-pressure chamber 23-air chamber 34" may be set as one unit, and a plurality of units may be arranged.

The configuration of providing the air chambers 34 in this way is inferior in resolution to the above-described embodiments. However, the crosstalk due to the driving of each pressure chamber 23 can be further reduced, and the drive efficiency of the pressure chamber 23 can be increased.

Regarding the nozzle-part discharge path 26*a* and the discharge paths 26*b*, 26*c*, the individual communication paths 422, and the common flow path 421 for the case of providing the air chambers 34, the embodiments of the nozzle-part discharge path 26*a* and the discharge paths 26*b*, 26*c* and the embodiments of the individual communication paths 422 and the common flow path 421 mentioned above can be freely combined to form the ink jet head 1.

[Pressure Loss Adjusting Means]

It is preferable that pressure loss adjusting means for adjusting the relative relationship between the flow path resistance of the main flow path F1 and the flow path resistance of the sub flow path F2 be provided in the ink jet head 1.

This pressure loss adjusting means imparts, to the main flow path F1, a pressure loss ΔP corresponding to a difference in flow path resistance between the main flow path F1 and the sub flow path F2. Alternatively, the pressure loss adjusting means reduces the flow path resistance of the sub flow path F2 to a value equivalent to the flow path resistance of the main flow path F1.

The flow path resistance of the sub flow path F2 is determined by the flow path diameter, the flow path length, the number of bent sections, the flow speed, and the like of the entire discharge flow path 423 including all the injection holes 31*a*, all the individual communication paths 422, and the common flow path 421. The individual communication paths 422 and the common flow path 421 each have a very small flow path diameter and a large flow path length, and thus generate a large flow path resistance.

In this ink jet head 1, the pressure loss adjusting means balances the flow path resistance of the main flow path F1 and the flow path resistance of the sub flow path F2, whereby ink can be uniformly delivered to the main flow path F1 and the sub flow path F2 easily with an ink pressure P0 in the ink supply pipe 5*a*.

Figure 12:
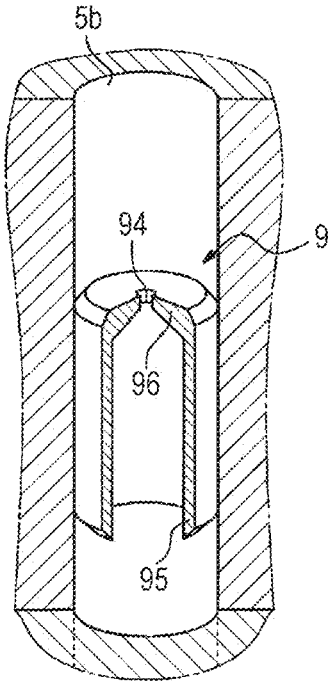
FIG. 12 is a partially cutaway perspective view illustrating an example of a flow rate adjusting member in an ink collection pipe.

An example of the pressure loss adjusting means is illustrated in FIG. 12. FIG. 12 is a partially cutaway perspective view illustrating the ink collection pipe 5*b* provided with an example of the pressure loss adjusting means.

As illustrated in FIG. 12, the flow rate adjusting member 9 for partially narrowing the flow path cross-sectional area of the ink collection pipe 5*b* can be used as the pressure loss adjusting means, for example. The flow rate adjusting member 9 is a member that is held in the ink collection pipe 5*b* and partially narrows the inner diameter of the ink collection pipe 5*b*. The flow rate adjusting member 9 of the present embodiment integrally includes a cylindrical portion 95 extending along the inner wall of the ink collection pipe 5*b* and a disk portion 96 which closes one end of the cylindrical portion 95. A flow path hole 94 is formed in the central portion of the disk portion 96. The flow path of the ink collection pipe 5*b* at the portion where the flow rate adjusting member 9 is disposed is only the flow path hole 94. Accordingly, the flow rate adjusting member 9 partially narrows the flow path cross-sectional area of the ink collection pipe 5*b* by the flow path hole 94 to cause a loss of the pressure of the ink flowing through the ink collection pipe 5*b*.

The material of the flow rate adjusting member 9 is not limited, but may be metal such as stainless steel, ceramics, and synthetic resin which are advantageous in terms of ink impermeability, ease of insertion into the ink collection pipe 5*b*, and corrosion resistance to ink.

By shortening the flow path length in the flow path hole 94 of the flow rate adjusting member 9, fluctuation in flow path resistance can be suppressed when air bubbles enter the flow path hole 94, and fluctuation in flow speed can be suppressed. The flow path length in the flow path hole 94 of the flow rate adjusting member 9 illustrated in FIG. 11 is, for example, about 0.5 mm. By setting the flow path length in the flow path hole 94 to about 0.5 mm, fluctuation in flow path resistance due to air bubbles can be suppressed.

The pressure loss ΔP imparted by the flow rate adjusting member 9 corresponds to a difference in flow path resistance between the main flow path F1 and the sub flow path F2 and is adjusted by the inner diameter of the flow path hole 94. This pressure loss ΔP balances the flow path resistance of the main flow path F1 and the flow path resistance of the sub flow path F2. That is, the ink pressure P0 in the ink supply pipe 5*a* is reduced to a pressure P1 immediately before the ink reaches the buffer space 6 of the main flow path F1. The pressure P1 is almost equal to a pressure P2 measured immediately before the ink reaches the buffer space 6 of the sub flow path F2. The ink pressure P0 in the ink supply pipe 5*a* is almost equal to the pressure provided by the transfer pump 105. The pressure P2 of the sub flow path F2 is set smaller than a pressure Px that causes a meniscus break so as not to cause a meniscus break from the nozzles 22.

Note that the ink pressure P0 can be measured with a manometer at a T-shaped branch provided in the ink supply pipe 5*a*. The pressure P1 can be measured with a manometer at a T-shaped branch provided in the ink collection pipe 5*b* (downstream from the flow rate adjusting member 9 and upstream from the buffer space 6). The pressure P2 can be measured with a manometer at a T-shaped branch provided in the ink discharge pipe 5*c* (upstream from the buffer space 6).

The specific inner diameter of the flow path hole 94 of the flow rate adjusting member 9 is appropriately determined in consideration of pressure loss due to pressure loss elements such as the individual communication paths 422 and the common flow path 421 such that the ink collection pipe 5*b* has a desired pressure loss. Adjusting the inner diameter of the flow path hole 94 of the flow rate adjusting member 9 enables ink to be uniformly delivered to the main flow path F1 and the sub flow path F2. As a result, it is possible to quickly store ink in the common ink chamber 41 (main flow path F1), each of the pressure chambers 23, the individual communication paths 422, and the common flow path 421 (sub flow path F2), which is particularly preferable for the initial introduction of ink.

As illustrated in FIG. 1 and FIG. 2, the ink discharge pipe 5*c* may be provided with a check valve 8. The check valve 8 functions to allow ink to flow out from the ink discharge chamber 412 toward the buffer space 6 and to prevent the flow of ink in the opposite direction. For example, if each individual communication path 422 and the common flow path 421 are clogged with impurities contained in ink, the pressure P2 of the sub flow path F2 drops, causing a pressure difference between the pressure P2 and the pressure P1 of the main flow path F1 in the common ink chamber 41. In this case, the ink collected from the ink collection pipe 5*b* may flow back to the ink discharge pipe 5*c* through the buffer space 6. The check valve 8 provided in the ink discharge pipe 5*c* can prevent air bubbles and impurities from returning to each individual communication path 422 and the common flow path 421 due to the reverse flow of ink.

Note that this check valve 8 is also one of the pressure loss elements. Therefore, it is preferable that the cracking pressure (valve opening pressure) of the check valve be low. In particular, the cracking pressure needs to be lower than the pressure Px (e.g., about 5 kPa) that causes a meniscus break from the nozzles 22. In order to reliably prevent a meniscus break from the nozzles 22, a suction pump may be provided in the ink return pipe 103 (downstream from the buffer space 6 for the ink collection pipe 5*b* and the discharge flow path 423) without applying pressure with the transfer pump 105 so that ink is circulated only by the negative pressure generated by the suction pump.

In the ink jet recording apparatus 100 according to the embodiments described above, ink is circulated between the ink jet head 1 and the ink tank 101. However, the present invention is not limited to these embodiments. Although not illustrated, the ink flowing out from the ink collection pipe 5*b* and the ink discharge pipe 5*c* may be discharged to a waste ink tank, instead of being returned to the ink tank 101.

[Another Embodiment of Ink Jet Head]

Figure 13:
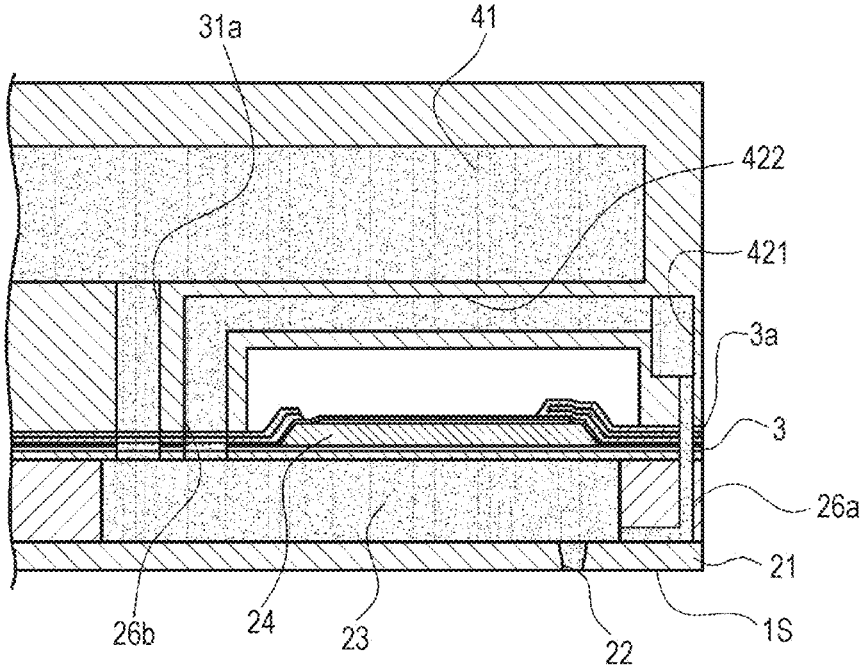
FIG. 13 is a longitudinal sectional view illustrating still another example of the ink jet head according to the present invention.
Figure 14:
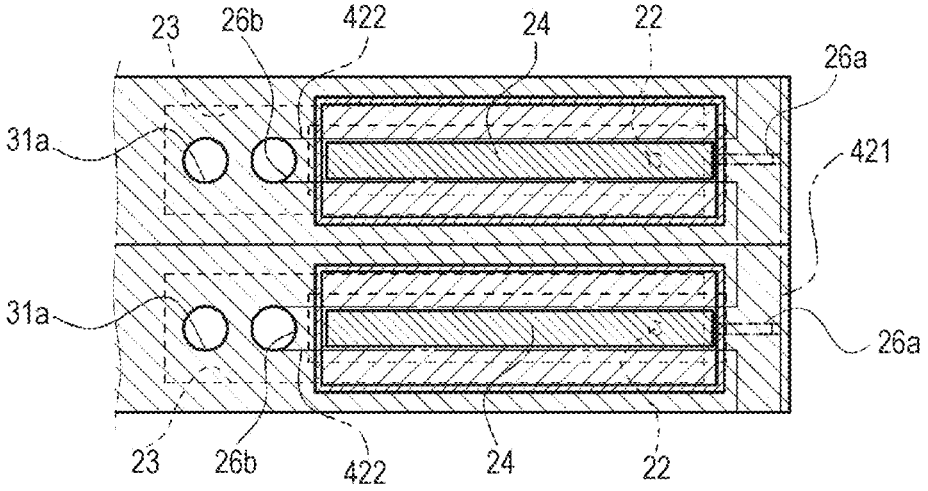
FIG. 14 is a transverse sectional view illustrating still another example of the ink jet head according to the present invention.

In this exemplary embodiment, the ink jet head according to the present invention is configured as an ink jet head of a type other than the shear mode type. FIG. 13 is a longitudinal sectional view illustrating still another example of the ink jet head according to the present invention, and FIG. 14 is a transverse cross-sectional view illustrating still another example of the ink jet head according to the present invention. Since components denoted by the same reference signs as those in FIG. 1 have the same configurations as those in FIG. 1, the above description is incorporated herein by reference and will not be repeated here.

As illustrated in FIG. 13 and FIG. 14, the ink jet head 1 according to the present invention may include the piezoelectric elements 24 disposed on the board 3. In this ink jet head 1, the piezoelectric elements 24 are disposed on the board 3, and the pressure chambers 23 serving as ink channels are formed on the lower surface side of the board 3. Each of the piezoelectric elements 24 forms a part of the upper surface (ceiling surface) of the pressure chamber 23, and is driven to cause a volume fluctuation in the pressure chamber 23. The lower surface (bottom surface) of the pressure chamber 23 is closed by the nozzle plate 21. A plurality of ejection nozzles 22 corresponding to the pressure chambers 23 is formed in the nozzle plate 21. The ejection nozzles 22 communicate with the pressure chambers 23 to allow the pressure chambers 23 to communicate with the outside (downward). The lower surface portion of the nozzle plate 21 is referred to as the ink ejection surface 1S. The ink in each pressure chamber 23 is subjected to an ejection pressure by the action of the piezoelectric elements 24, and ejected toward the outer (downward) recording medium through the ejection nozzle 22.

The pressure chambers 23 communicate with the common ink chamber 41 via the injection holes 31*a*. The ink in the common ink chamber 41 is injected into the pressure chambers 23 via the injection holes 31*a*.

The area near the end apart from the nozzle 22 inside the pressure chamber 23 (space between the injection hole 31*a* and the nozzle 22) communicates with the individual communication path 422 via the discharge path 26*b* adjacent to the inflow path from the injection hole 31*a* to the pressure chamber 23. These individual communication paths 422 communicate with and join the common flow path 421. Further, the area near the nozzle 22 in the pressure chamber 23 communicates with the common flow path 421 via the nozzle-part discharge path 26*a*. As described above, the ink that has reached the common flow path 421 reaches the ink discharge chamber 412 and joins the ink collection pipe 5*b* via the ink discharge pipe 5*c*.

As described above, according to the ink jet head and the ink jet recording apparatus described above, remaining air bubbles in the pressure chambers 23 can be satisfactorily removed.

REFERENCE SIGNS LIST

1 ink jet head
2 head chip
21 nozzle plate
22 nozzle
23 pressure chamber
24 piezoelectric element
25 pseudo pressure chamber
26*a* nozzle-part discharge path
26*b* discharge path
26*c* discharge path
27 lid member
3 wiring board
31*a* injection hole
31*b* discharge hole
33 flow path plate
34 air chamber
35 wall surface

4 ink manifold
41 common ink chamber
412 ink discharge chamber
421 common flow path
422 individual communication path
423 discharge flow path
424 discharge channel
45 partition wall
5*a* ink supply pipe
5*b* ink collection pipe
5*c* ink discharge pipe
6 buffer space
61 junction box
8 check valve
9 flow rate adjusting member
F1 main flow path
F2 sub flow path
100 ink jet recording apparatus
101 ink tank
102 ink transfer pipe
103 ink return pipe
104 control unit
105 transfer pump

The invention claimed is:

1. An ink jet head comprising:

a common ink chamber that stores ink;

at least one pressure chamber that communicates with the common ink chamber via an injection hole such that ink is injected into the pressure chamber from the common ink chamber via the injection hole, the pressure chamber causing a volume fluctuation using pressure generation means;

a nozzle that communicates with the pressure chamber and serves as a flow path of ink ejected to outside from the pressure chamber;

a nozzle-part discharge path that communicates with the pressure chamber near the nozzle inside the pressure chamber and discharges ink out of the pressure chamber; and at least one discharge path that communicates with the pressure chamber at a position apart from the nozzle inside the pressure chamber and discharges ink out of the pressure chamber;

wherein the nozzle-part discharge path and the discharge path are formed in a nozzle plate provided with the nozzle.

2. The ink jet head according to claim 1, wherein a plurality of the discharge paths is provided per pressure chamber.

3. The ink jet head according to claim 2, wherein the discharge path communicates with the pressure chamber near an end apart from the nozzle inside the pressure chamber.

4. The ink jet head according to claim 2, wherein a flow path resistance of the discharge path is equal to or less than a flow path resistance of the nozzle-part discharge path.

5. The ink jet head according to claim 2, wherein an average cross-sectional area of the discharge path is equal to or larger than an average cross-sectional area of the nozzle-part discharge path.

6. The ink jet head according to claim 2, wherein the nozzle-part discharge path and the discharge path communicate with a common flow path.

7. The ink jet head according to claim 2, wherein a plurality of the pressure chambers is arranged in series, and two partition walls in an arrangement direction of each pressure chamber are piezoelectric elements that are the pressure generator.

8. The ink jet head according to claim 1, wherein the discharge path communicates with the pressure chamber near an end apart from the nozzle inside the pressure chamber.

9. The ink jet head according to claim 1, wherein a flow path resistance of the discharge path is equal to or less than a flow path resistance of the nozzle-part discharge path.

10. The ink jet head according to claim 1, wherein an average cross-sectional area of the discharge path is equal to or larger than an average cross-sectional area of the nozzle-part discharge path.

11. The ink jet head according to claim 1, wherein the nozzle-part discharge path and the discharge path communicate with a common flow path.

12. The ink jet head according to claim 1, wherein a plurality of the pressure chambers is arranged in series, and two partition walls in an arrangement direction of each pressure chamber are piezoelectric elements that are the pressure generation means, the ink jet head has pseudo pressure chambers and air chambers that are arranged together with the pressure chambers and cause a volume fluctuation in accordance with a volume fluctuation in the pressure chambers, the nozzle-part discharge path and the discharge path communicate with the pseudo pressure chambers, and the air chambers are sealed.

13. An ink jet recording apparatus comprising:

the ink jet head according to claim 1;

an ink tank in which ink to be transferred to the ink jet head is stored; and an ink transfer unit that transfers ink inside the ink tank to the ink jet head.

14. An ink jet recording apparatus comprising:

the ink jet head according to claim 1;

an ink tank in which ink to be transferred to the ink jet head is stored; and an ink transfer unit that transfers ink inside the ink tank to the ink jet head and collects ink transferred to the ink jet head, wherein ink discharged from the pressure chamber through the nozzle-part discharge path or the discharge path joins ink collected from the ink jet head.

15. An ink jet head comprising:

a common ink chamber that stores ink;

at least one pressure chamber that communicates with the common ink chamber via an injection hole such that ink is injected into the pressure chamber from the common ink chamber via the injection hole, the pressure chamber causing a volume fluctuation using pressure generation means;

a nozzle that communicates with the pressure chamber and serves as a flow path of ink ejected to outside from the pressure chamber;

a nozzle-part discharge path that communicates with the pressure chamber near the nozzle inside the pressure chamber and discharges ink out of the pressure chamber; and at least one discharge path that communicates with the pressure chamber at a position apart from the nozzle inside the pressure chamber and discharges ink out of the pressure chamber;

wherein a plurality of the pressure chambers is arranged in series, and two partition walls in an arrangement direction of each pressure chamber are piezoelectric elements that are the pressure generation means.

16. The ink jet head according to claim 15, wherein an inner length of each of the pressure chambers in a direction orthogonal to the arrangement direction of each pressure chamber and to an ink ejection direction is larger than an inner length of the pressure chamber in the arrangement direction.

17. An ink jet head comprising:

a common ink chamber that stores ink;

at least one pressure chamber that communicates with the common ink chamber via an injection hole such that ink is injected into the pressure chamber from the common ink chamber via the injection hole, the pressure chamber causing a volume fluctuation using pressure generation means;

a nozzle that communicates with the pressure chamber and serves as a flow path of ink ejected to outside from the pressure chamber;

a nozzle-part discharge path that communicates with the pressure chamber near the nozzle inside the pressure chamber and discharges ink out of the pressure chamber; and at least one discharge path that communicates with the pressure chamber at a position apart from the nozzle inside the pressure chamber and discharges ink out of the pressure chamber;

wherein a plurality of the pressure chambers is arranged in series, and two partition walls in an arrangement direction of each pressure chamber are piezoelectric elements that are the pressure generation means, the ink jet head has pseudo pressure chambers arranged together with the pressure chambers and positioned on both sides of the pressure chambers, the pseudo pressure chambers causing a volume fluctuation in accordance with a volume fluctuation in the pressure chambers, and the discharge path and the nozzle-part discharge path communicate with the pseudo pressure chambers.

18. The ink jet head according to claim 17, wherein a cross-sectional area of each of the pseudo pressure chambers perpendicular to the nozzle is larger than a cross-sectional area of the pressure chamber.

19. The ink jet head according to claim 17, wherein the ink jet head has pseudo pressure chambers and air chambers that are arranged together with the pressure chambers and cause a volume fluctuation in accordance with a volume fluctuation in the pressure chambers, the nozzle-part discharge path and the discharge path communicate with the pseudo pressure chambers, and the air chambers are sealed.

* * * * *